US005685466A

United States Patent [19]

Hsieh

[11] Patent Number: 5,685,466

[45] Date of Patent: Nov. 11, 1997

[54] MULTIFUNCTIONAL SAFETY INFANT CARRYING BAG STRUCTURE

[75] Inventor: Tzai-Sau Hsieh, Changhua City, Taiwan

[73] Assignee: An Tien Enterprise Co., Ltd., Changhua, Taiwan

[21] Appl. No.: 585,154

[22] Filed: Jan. 11, 1996

[51] Int. Cl.[6] ..... A61G 1/00

[52] U.S. Cl. ..... 224/160; 224/159

[58] Field of Search ..... 224/158, 159, 224/160, 161

[56] References Cited

U.S. PATENT DOCUMENTS

| | | | |
|---|---|---|---|
| 4,402,440 | 9/1983 | Purtzer et al. | 224/160 |
| 5,490,620 | 2/1996 | Bergqvist | 224/160 |

FOREIGN PATENT DOCUMENTS

| | | | |
|---|---|---|---|
| 611234 | 8/1994 | European Pat. Off. | 224/160 |
| 92016130 | 10/1992 | WIPO | 224/160 |

*Primary Examiner*—Henry J. Recla

*Assistant Examiner*—Gregory M. Vidovich

*Attorney, Agent, or Firm*—Browdy and Neimark

[57] ABSTRACT

A multifunctional safety infant carrying bag structure including a back sheet, a soft back pad, an infant bag and a cover sheet. The backsheet consists of a first and a second soft mesh pad disposed with two rows of female buckles on the bottom face and female zippers on two lateral sides; two fastening waist belts disposed at two ends of the back sheet, having adjustment rings, insertion fasteners, fastening rings and socket fasteners; and a right and a left shoulder belt disposed with fastening rings and female zippers. The infant bag has two male zippers on two sides of upper face and several insertion fastener sets on two lateral sides. The cover sheet has an upper wide end disposed with two fastening hooks and a lower narrow end disposed with two fastening hooks. The infant can be safely carried in the infant bag structure on the user's back or chest or laterally carried on the user's chest or in an obliquely lying state. The carrying bag structure relieves user back tiredness and air-permeability avoids a hot feeling. Also, the infant can be taken out of the infant bag in a more convenient and easier way.

1 Claim, 4 Drawing Sheets

MULTIFUNCTIONAL SAFETY INFANT CARRYING BAG STRUCTURE

BACKGROUND OF THE INVENTION

The present invention relates to a multifunctional safety infant carrying bag structure which permits an infant to be safely carried therein on a user's back or chest or laterally carried on the user's chest or in an obliquely lying state. Tiredness or injury of the user at the back is relieved or eliminated and the air-permeability avoids a hot feeling. Also, the infant can be taken out of the infant bag in a more convenient and easier way.

PRIOR ART

A conventional infant carrying bag structure can be used to carry an infant on a user's back or chest or in an obliquely lying state. In the case of carrying the infant on the back, the user's back may suffer a considerably great depressing force and is subject to tiredness or even injury such as osteocope. Moreover, the space between the infant and the user's back cannot be ventilated. In the case of obliquely lying state, the cover sheet is folded inward to cover the infant's face. This may result in suffocation of the infant. In the case of carrying the infant on the chest, the movement of the user's hands is restricted. In addition, no matter whether the infant is carried on the back or the chest, the user has difficulty seeing and taking care of the infant. Also, the sight of the infant is interrupted by the user's body. This could lead to visual damage of the infant. Furthermore, the conventional infant bag structure is closed on two sides Without any reclosable opening. Therefore, it is quite inconvenient to take the infant out of the infant bag.

SUMMARY OF THE INVENTION

It is therefore a primary object of the present invention to provide a multifunctional safety infant carrying bag structure by which the tiredness or injury (such as osteocope) of the user at the back is relieved or eliminated. Also, the infant carrying bag structure has good air-permeability which avoids a hot feeling.

It is a further object of the present invention to provide the above infant carrying bag structure in which the infant can be safely carried on the user's back or chest or laterally carried on the chest or in an obliquely lying state so as to increase the moving space of the user's hands and make it easier for the user to see and take care of the infant without limitation of the sight of the infant. Also, when the infant obliquely lies in the infant bag structure, the infant is prevented from being suffocated.

It is still a further object of the present invention to provide the above infant carrying bag structure in which the insertion fasteners of the infant bag permit the infant to be taken out in a more convenient and easier way.

The present invention can be best understood through the following description and accompanying drawings, wherein:

DETAILED DESCRIPTION OF THE PREFERRED EMBODIMENT

Figure 1:
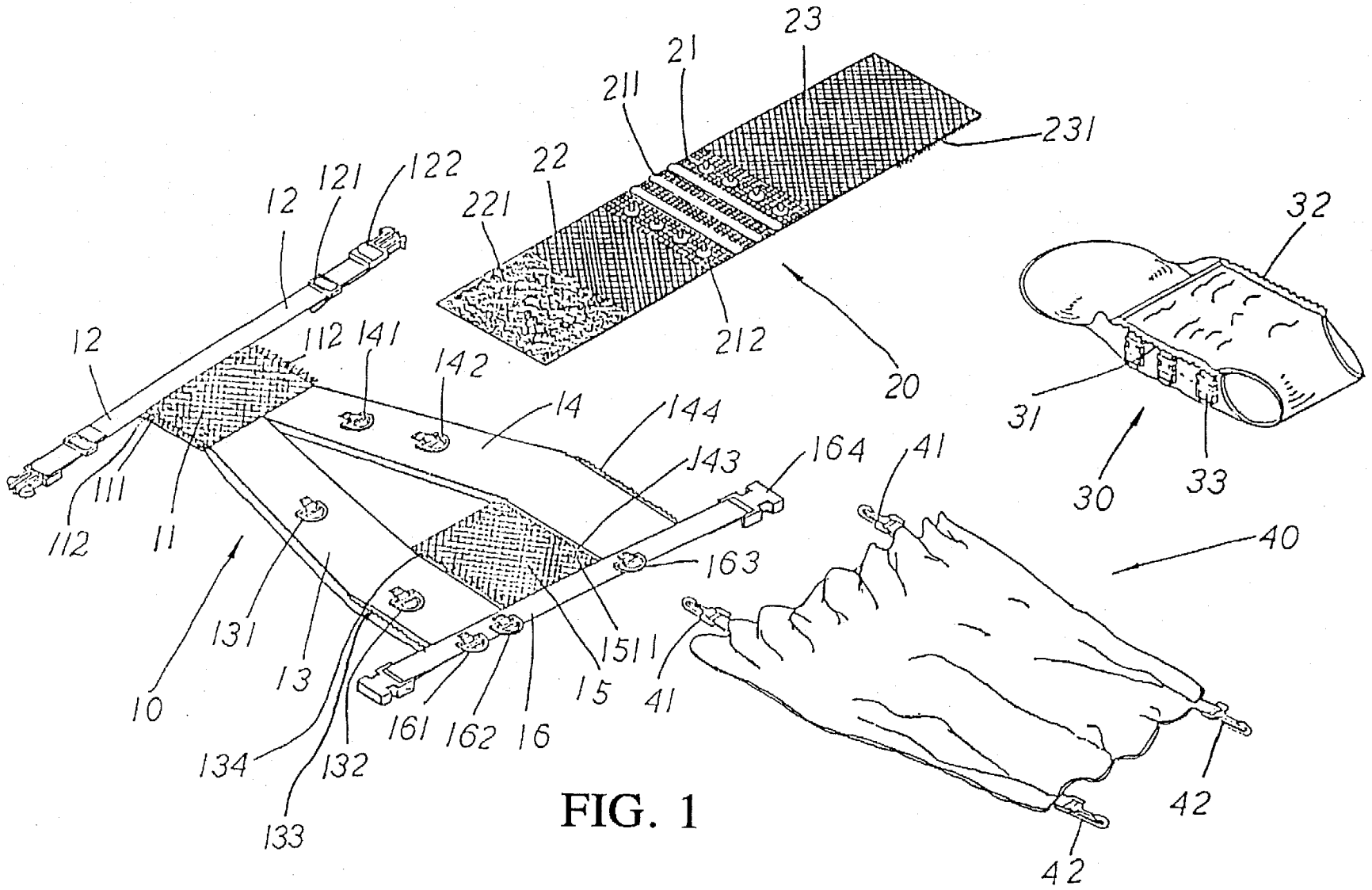
FIG. 1 is a perspective exploded view of the present invention.

Please refer to FIG. 1. The present invention includes a back sheet 10, a soft back pad 20, an infant bag 30 and a cover sheet 40. The back sheet 10 consists of a first soft mesh pad 11 disposed with two rows of female buckles 111 on a bottom face and female zippers 112 on two lateral sides; a fastening waist belt 12 extending respectively from each side of the upper end of the first soft mesh pad 11. The fastening waist belt 12 is equipped with two adjustment rings 121 and two insertion fasteners 122. The back sheet 10 further includes right and left shoulder belts 13, 14 extend down from a lower end of the first soft mesh pad 11. The right shoulder belt 13 being disposed with two fastening rings 131, 132, respectively on middle and lower portions. The left shoulder belt 14 being disposed with two fastening rings 141, 142 respectively on upper and middle portions thereof. Each shoulder belt 13, 14 being respectively disposed with two female zippers 133, 134, 143, 144 on two sides of the lower portion of the belts 13, 14. A second soft mesh pad 15 is disposed under bottom faces of the lower portions of the two shoulder belts 13, 14. Two rows of female buckles 151 are disposed on the bottom of the second soft mesh pad 15. Another fastening waist belt 16 is connected with lower ends of the two shoulder belts 13, 14. Fastening waist belt 16 is disposed with two fastening rings 161, 162 on a right portion and a fastening ring 163 on the left portion thereof. Fastening waist belt 16 has a socket fastener 164 at each of two ends. The soft back pad 20 has a middle irresilient mesh 21 disposed with several soft ribs 211 for softly supporting a user's back. Two rows of male buckles 212 are disposed on two sides of the soft ribs 211. Right and a left resilient meshes 22, 23 are connected with two ends of the irresilient mesh 21. The right resilient mesh 22 is disposed with a female fastening face 221 on an upper face and the left resilient mesh 23 is disposed with a male fastening face 231 on a bottom face.

The infant bag 30 is disposed with two male zippers 31, 32 on two sides of upper face and several insertion fastener sets 33 on two lateral sides providing an operable closure along each of the sides. The cover sheet 40 has an upper wide end disposed with two fastening hooks 41 and a lower narrow end disposed with two fastening hooks 42.

Figure 2:
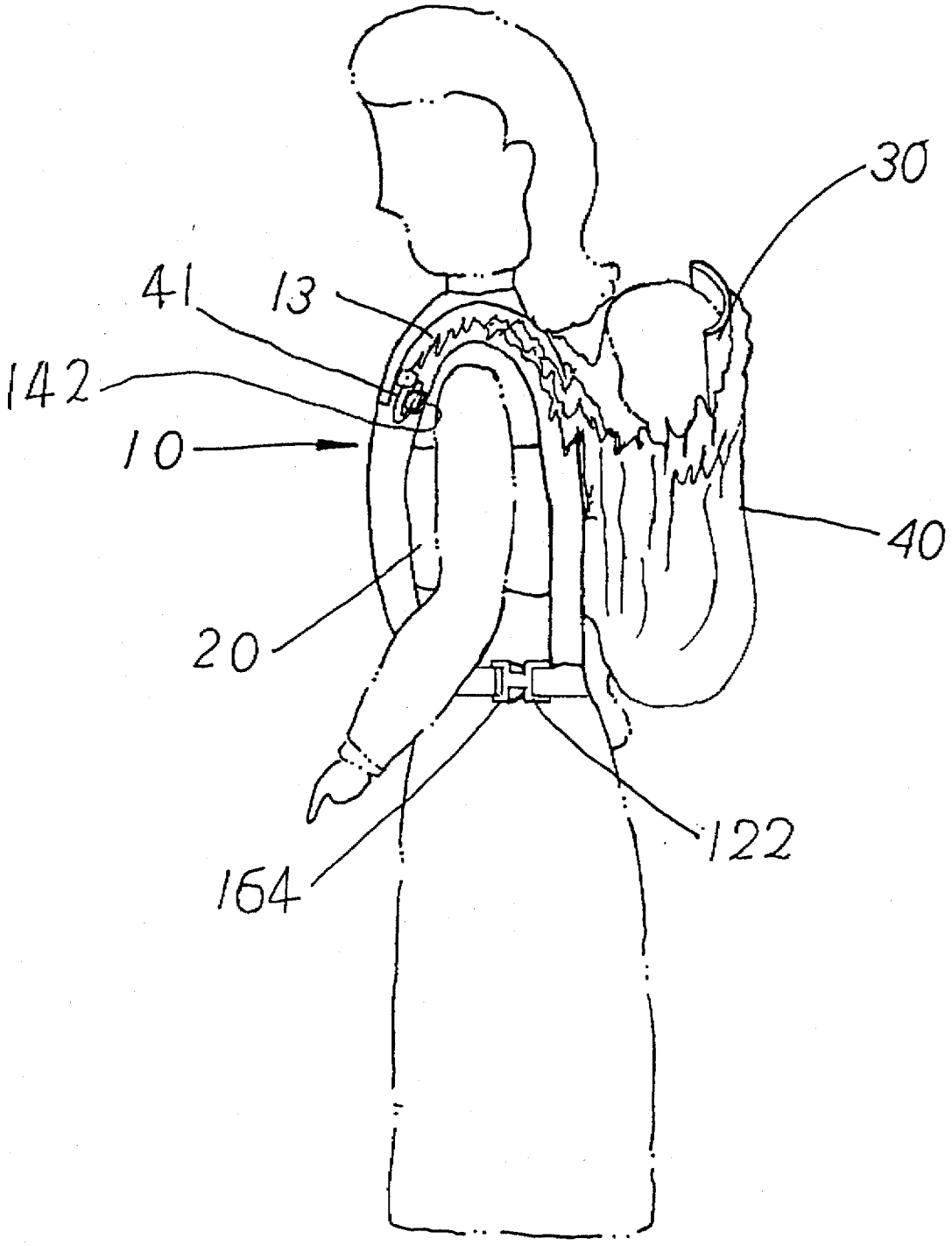
FIG. 2 shows an infant carried in the invention of FIG. 1 on a user's back.

Please refer to FIG. 2. When the present invention is used to carry the infant on the back, the irresilient mesh 21 of the soft back pad 20 is faced toward the back of the user and fastened on the body of the user by means of the male and female fastening faces 231, 221. Then the female buckles 111 of the first soft mesh pad 11 are fastened with the male buckles 212 of the soft back pad 20. The infant is rested in the infant bag 30 with the upper face thereof faced toward the user's back. The male zippers 31, 32 of the infant bag 30 are binded with the female zippers 112 of the first soft mesh pad 11. Then the back sheet 10 is fitted around the user's head with the shoulder belts 13, 14 located on the user's shoulders and the insertion fasteners 122 inserted into the socket fasteners 164. At this time, the soft ribs 211 of the soft back pad 20 serve to support the back of the user. In addition, the fastening hooks 41 of the upper wide end of the cover sheet 40 are pulled forward toward the user's chest and fastened with the middle fastening ring 131 of the right shoulder belt 13 and the middle fastening ring 142 of the left shoulder belt 14. The fastening hooks 42 of the lower end of the cover sheet 40 are fastened with the fastening rings 162, 163 of the waist belt 16 for achieving a warmness-keeping effect.

Figure 3:
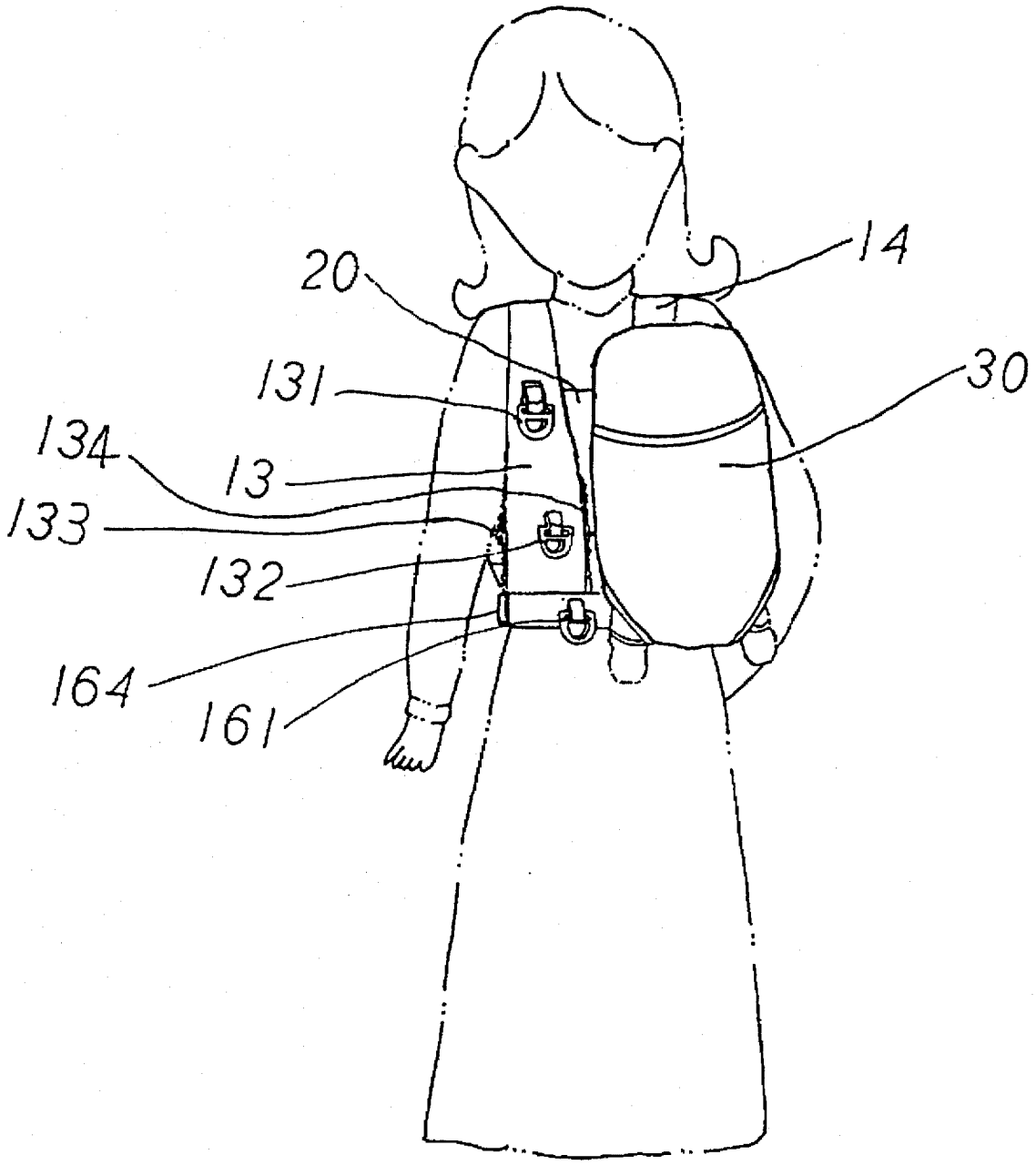
FIG. 3 shows an infant carried laterally in the invention of FIG. 1 on a user's chest.

Please refer to FIG. 3. When the present invention is used to carry the infant on the chest, the irresilient mesh 21 of pad 20 can be faced toward the front of the user and fastened on the body by fastening faces 231, 221. Then the female buckles 151 of mesh pad 11 can be fastened with the male buckles 212 of pad 20. The male zippers 31, 32 of the infant bag 50 are binded with the female zippers 134, 143 of the two shoulder belts 13, 14. Alternatively, the infant can be laterally carried on the chest in such a manner that the upper face of the infant bag 30 is on the left or right side of the user's chest by binding the female zippers 133, 134 or 143, 144 of the respective shoulder belts 13, 14, to the counterpart male zippers 31, 32 on the infant bag 30. When it is desired to take the infant out of the infant bag 30, the insertion fastening sets 33 on one side of the infant bag 30 can be first unfastened to form an opening so as to facilitate taking out of the infant.

Figure 4:
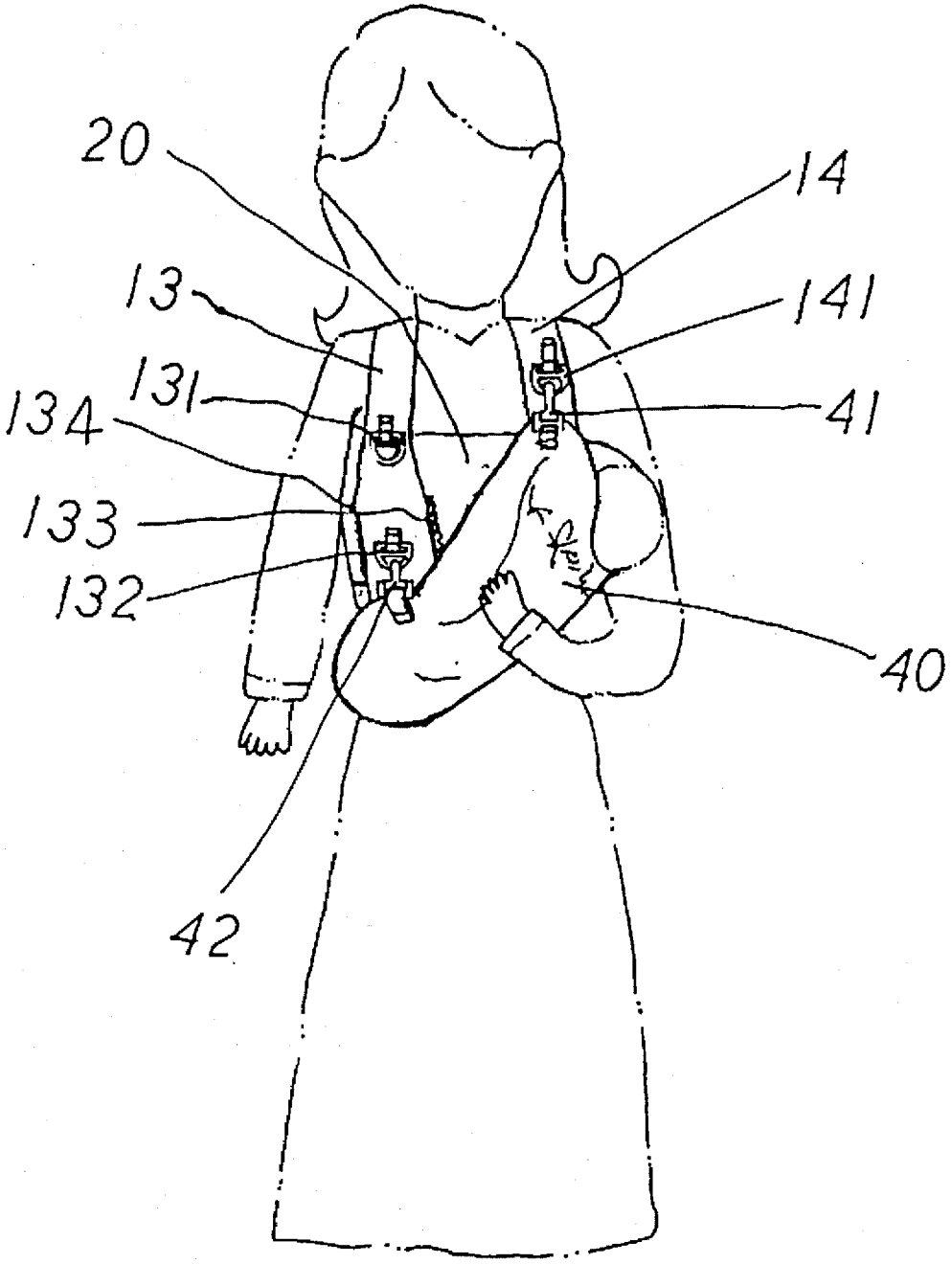
FIG. 4 shows an infant carried in the invention of FIG. 1 in an obliquely lying state.

Please refer to FIG. 4. When the infant is carried on the chest in an obliquely lying state, the infant bag 30 is not used and an outward fastening hook 41 of the upper end of the cover sheet 40 is fastened with the upper fastening ring 141 of the left shoulder belt 14 and an inward fastening hook 41 is fastened with the middle fastening ring 142 of the left shoulder belt 14 and an outward fastening hook 42 of the lower end is fastened with the lower fastening ring 132 of the right shoulder belt 13 and an inward fastening hook 42 is fastened with the upper fastening ring 161 of the waist belt 16. Accordingly, a height of opening is defined at the head of the infant to prevent the infant from being covered at the face and suffocated.

According to the above arrangements, the present invention at least has the advantages as follows:

1. The tiredness or injury of the user at the back is relieved or eliminated and the air-permeability avoids hot feeling.
2. The infant can be laterally carried on the chest so as to enlarge the moving space of the user's hands and make it easier for the user to see and take care of the infant without limitation of the sight of the infant.
3. The infant is allowed to obliquely lie in the present invention without the possibility of suffocation.
4. The insertion fastener sets of the infant bag permit the infant to be taken out in a more convenient and easier way.

The above embodiment is only an example of the present invention and the scope of the present invention should not be limited to the example. Any modification or variation derived from the example should fall within the scope of the present invention.

What is claimed is:

1. A multifunctional infant carrying device comprising:

a back sheet including a first soft mesh pad having a first and a second end, a first and a second lateral side and a top and a bottom face, two rows of female buckles disposed on said bottom face and female fasteners disposed on each said lateral side, a first fastening waist belt connected to said first end and having opposing end portions extending beyond each said lateral side, wherein each of said end portions is equipped with an adjustment ring and an insertion fastener, a right and a left shoulder belt each having an upper portion connected to said second end of said first pad, a lower portion and a middle portion therebetween and opposed lateral sides, said left shoulder belt having two fastening rings disposed thereon adjacent said upper portion and said middle portion, respectively, said right shoulder belt having two fastening rings disposed thereon adjacent said middle portion and said lower portion, respectively, each said shoulder belt having female zippers disposed on each lateral side thereof at said lower portion, a second soft mesh pad having a first and a second end, a first and a second lateral side and a top and a bottom face, said top face of said second pad being attached to and under said lower portion of each said shoulder belt, a second fastening waist belt connected to said lower portion of each said shoulder belt and having a right and a left portion wherein said right portion of said second belt includes two fastening rings and a socket fastener disposed thereon and said left portion of said second belt includes a fastening ring and a socket fastener disposed thereon;

a soft back pad including a right resilient mesh portion, a left resilient mesh portion and a middle non-resilient mesh portion therebetween, said non-resilient middle portion having several soft ribs disposed thereon and two rows of male buckles respectively disposed laterally of said ribs, said right and left resilient mesh portions including cooperative fastening means thereon for connecting each said right and left resilient mesh portions;

an infant bag having two male zippers respectively disposed on opposing lateral sides thereof and several insertion fastener sets respectively disposed on each of said lateral sides of said infant bag to thereby provide an openable closure along each of said lateral sides of said infant bag; and a cover sheet having an upper end having two fastening hooks disposed thereon and a lower end having two fastening hooks disposed thereon and has a width shorter than said upper end of said cover sheet;

wherein, in use, said soft back pad is disposed about a torso of the user with said non-resilient portion located adjacent the user with said soft ribs facing outwardly and said right and left resilient portions being connected adjacent the user, said back sheet is disposed about the user with said buckles on said first mesh pad or said second mesh pad respectively connected to said buckles on said non-resilient portion of said soft back pad, each said shoulder belt is disposed over the shoulders of the user such that said second mesh pad is positioned adjacent the front of the user and said first fastening belt and said second fastening belt are connected together around the user by respectively connecting said insertion fasteners and said socket fasteners;

wherein said two male zippers of said infant carrying bag can be selectively connected to a pair of said female zippers on either or both of each said shoulder belt and said fastening hooks on said lower end and said upper end of said cover sheet can be selectively connected to said fastening rings on each said shoulder belt and said second fastening belt.

* * * * *